US010337792B2

(12) United States Patent
Prosser et al.

(10) Patent No.: US 10,337,792 B2
(45) Date of Patent: Jul. 2, 2019

(54) SYSTEM AND METHOD FOR PRODUCTION OF ARGON BY CRYOGENIC RECTIFICATION OF AIR

(71) Applicants: Neil M. Prosser, Lockport, NY (US); Karl K. Kibler, Amherst, NY (US); Maulik R. Shelat, Williamsville, NY (US)

(72) Inventors: Neil M. Prosser, Lockport, NY (US); Karl K. Kibler, Amherst, NY (US); Maulik R. Shelat, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 135 days.

(21) Appl. No.: 15/018,088

(22) Filed: Feb. 8, 2016

(65) Prior Publication Data

US 2016/0153712 A1 Jun. 2, 2016

Related U.S. Application Data

(63) Continuation-in-part of application No. 14/267,249, filed on May 1, 2014, now Pat. No. 9,291,389.

(51) Int. Cl.
*F25J 3/00* (2006.01)
*F25J 3/04* (2006.01)

(52) U.S. Cl.
CPC ..... *F25J 3/04721* (2013.01); *F25J 3/048* (2013.01); *F25J 3/04193* (2013.01); (Continued)

(58) Field of Classification Search
CPC .... F25J 3/04654; F25J 3/0443; F25J 3/04412; F25J 3/04672; F25J 3/04678; (Continued)

(56) References Cited

U.S. PATENT DOCUMENTS 3,167,113 A 1/1965 Kleiss
4,276,125 A 6/1981 Issei
(Continued)

FOREIGN PATENT DOCUMENTS

EP 0 860 670 A2 8/1998
EP 1 108 965 A1 6/2001
(Continued)

OTHER PUBLICATIONS

"On the use of intermdiate reboilers in the rectifying section and condensers in the stripping section of a distillation column" by Agrawal et al. (1996).*

*Primary Examiner* — Keith M Raymond
(74) *Attorney, Agent, or Firm* — Robert J. Hampsch

(57) ABSTRACT

A system and method for producing argon that uses a higher pressure column, a lower pressure column, and an argon column collectively configured to produce nitrogen, oxygen and argon products through the cryogenic separation of air. The present system and method also employs a once through argon condensing assembly that is disposed entirely within the lower pressure column that is configured to condense an argon rich vapor stream from the argon column against the oxygen-enriched liquid from the higher pressure column to produce an argon liquid or vapor product. The control system is configured for optimizing the production of argon product by ensuring an even flow split of the oxygen-enriched liquid is distributed to the argon condenser cores and by adjusting the flow rate of the argon removed from the argon condensing assembly to maintain the liquid/vapor balance in the argon condensing assembly within appropriate limits.

10 Claims, 4 Drawing Sheets

(52) U.S. Cl.
CPC ..... *F25J 3/04412* (2013.01); *F25J 3/04678* (2013.01); *F25J 3/04727* (2013.01); *F25J 3/04884* (2013.01); *F25J 2250/02* (2013.01); *F25J 2250/20* (2013.01)

(58) Field of Classification Search
CPC .. F25J 3/04703; F25J 3/04666; F25J 2215/58; F25J 2220/40; F25J 2250/02; F25J 2250/20; F25J 2250/04
See application file for complete search history.

(56) References Cited

U.S. PATENT DOCUMENTS

| | | | | |
|---|---|---|---|---|
| 4,670,031 | A | 6/1987 | Erickson | |
| 4,756,731 | A | 7/1988 | Erickson | |
| 4,790,866 | A | 12/1988 | Rathbone | |
| 4,822,395 | A | 4/1989 | Cheung | |
| 5,114,449 | A | 5/1992 | Agrawal et al. | |
| 5,122,174 | A * | 6/1992 | Sunder | F25J 3/0409 165/166 |
| 5,255,522 | A * | 10/1993 | Agrawal | F25J 3/04351 62/651 |
| 5,546,766 | A | 8/1996 | Higginbotham | |
| 5,916,261 | A | 6/1999 | Bonaquist et al. | |
| 5,956,973 | A | 9/1999 | Herron et al. | |
| 6,393,866 | B1 * | 5/2002 | Srinivasan | F25J 3/04412 165/166 |
| 6,397,632 | B1 | 6/2002 | Meagher | |
| 7,134,297 | B2 | 11/2006 | Corduan et al. | |
| 9,291,389 | B2 | 3/2016 | Kibler et al. | |
| 2006/0016215 | A1 * | 1/2006 | Tonkovich | B01D 3/146 62/617 |
| 2006/0283208 | A1 * | 12/2006 | Chakravarthy | F25J 3/04412 62/643 |
| 2012/0131951 | A1 | 5/2012 | Myobatake et al. | |
| 2016/0370111 | A1 | 12/2016 | Alekseev | |

FOREIGN PATENT DOCUMENTS

| | | | |
|---|---|---|---|
| EP | 1 336 805 | A1 | 8/2003 |
| JP | H07 133982 | A | 5/1995 |
| JP | 2004-163003 | A | 6/2004 |
| JP | 2006-266532 | | 10/2006 |

* cited by examiner

SYSTEM AND METHOD FOR PRODUCTION OF ARGON BY CRYOGENIC RECTIFICATION OF AIR

CROSS REFERENCE TO RELATED APPLICATIONS

The present application is a continuation-in-part application and claims the benefit of and priority to U.S. patent application Ser. No. 14/267,249 filed on May 1, 2014.

TECHNICAL FIELD

The present invention is related to a system and method for the cryogenic distillation of air using a multiple column distillation system to produce argon, in addition to nitrogen and/or oxygen, and more particularly to a system and method for producing argon using an argon condenser disposed internally within the lower pressure column of an air separation unit.

BACKGROUND

Argon is a highly inert element used in the some high-temperature industrial processes, such as steel-making where ordinarily non-reactive substances become reactive. Argon is also used in various types of metal fabrication processes such as arc welding as well as in the electronics industry, for example in silicon crystals growing processes. Still other uses of argon include medical, scientific, preservation and lighting applications.

Argon constitutes a minor portion of ambient air (i.e. 0.93%), yet it possesses a relatively high value compared to the oxygen and nitrogen products recovered from air separation units. Argon is typically recovered from the Linde-type double column arrangement by extracting an argon rich draw from the upper column and directing the stream to a third column or argon column to recover the argon. argon produced in this "superstaged" distillation process typically includes an argon condensing unit disposed within the argon column or situated between the argon column and the upper column of the Linde-type double column arrangement to produce the argon product. The argon condensation load is typically imparted to a portion of the oxygen rich column bottoms (e.g. kettle) prior to its introduction into the lower pressure distillation column.

Drawbacks of the typical three column argon producing air separation unit are the additional capital costs associated with argon recovery and the resulting column/coldbox heights, often in excess of 200 feet, are required to recover the high purity argon product. As a consequence, considerable capital expense is incurred to attain the high purity argon, including capital expense for split columns, multiple coldbox sections, argon condensing assembly, liquid reflux/return pumps, etc.

One particular concern is the argon condensing assembly used in many conventional air separation plants. The conventional argon condensing assembly consists of a large separation vessel containing multiple thermo-syphon type condensers and due to its size and external plumbing requirements and often increases the height of the air separation cold box. Some prior art solutions have addressed the column/coldbox heights by placing the argon condensing assembly in a separate vessel that is hung between the argon column and the low pressure column in lieu of stacking the argon condensing assembly above the argon column. In either arrangement, the argon vapor is typically drawn into the top of each condensing assembly via a manifold and is completely condensed with a portion of the kettle liquid from the higher pressure column or with cold vapor from the lower pressure column. In many prior art argon condensing assemblies, the condenser is disposed in a large separation vessel and partially submerged in a bath of the kettle liquid. The kettle liquid is typically drawn into the bottom of the condensers and flows upwards, boiling as it absorbs heat from the argon vapor. From a safety perspective, it is crucial to prevent complete vaporization of the kettle liquid within the boiling passages to ensure that there is adequate liquid to keep the surfaces are wetted. This is particularly important where the kettle liquid input to each condenser is a two phase flow.

There is a continuing need to develop an improved argon recovery process or arrangement which can enhance the safety, performance and cost-effectiveness of argon recovery in cryogenic air separation units, and in particular, to develop a lower cost and higher performing argon condensing assembly.

SUMMARY OF THE INVENTION

The present invention may be characterized as a method for producing argon in a cryogenic air separation unit comprising the steps of: (a) rectifying an argon-oxygen-containing stream in an argon column configured to produce an argon-rich vapor stream and an argon-oxygen containing liquid; (b) directing the argon rich vapor stream from the argon column to an argon condensing assembly disposed within a lower pressure column of the air separation unit; (c) directing the argon-oxygen containing liquid from the argon column to an intermediate location of a lower pressure column below the argon condensing assembly; (d) mixing a flow of an oxygen-enriched liquid from a higher pressure column of the cryogenic air separation unit with a down-flowing liquid in the lower pressure column at a location above the argon condensing assembly to form an oxygen-enriched mixed liquid stream; (e) feeding the oxygen-enriched mixed liquid stream to the argon condensing assembly; (f) condensing the argon rich vapor stream against the oxygen-enriched mixed liquid stream in the argon condensing assembly to produce a argon-rich liquid stream while vaporizing a portion of the oxygen-enriched mixed liquid stream in the argon condensing assembly; (g) releasing the vaporized portion of the oxygen-enrich mixed liquid stream from the argon condensing assembly into the lower pressure column at a location proximate the top of the argon condensing assembly; (h) releasing the non-vaporized portion of the oxygen-enrich mixed liquid stream from the argon condensing assembly into the lower pressure column at a location proximate the bottom of the argon condensing assembly; and (i) removing at least a portion of the argon-rich liquid stream from the lower pressure column. A first portion of the argon-rich liquid stream may be recycled back to the argon column as reflux while a second portion may be taken as argon product.

The present invention may also be characterized as a system for producing a argon product by cryogenic rectification of a feed air stream comprising: (i) a source of compressed and purified feed air; (ii) a higher pressure column configured to produce an oxygen-enriched liquid and a nitrogen-rich overhead stream by cryogenic rectification of a portion of the compressed and purified feed air within the higher pressure column; (iii) a lower pressure column configured to receive the nitrogen rich overhead stream from the higher pressure column and produce an oxygen product stream and a nitrogen-rich stream by cryogenic rectification within the lower pressure column as well as an argon-oxygen-containing side stream; (iv) an argon column operatively coupled to the lower pressure column and configured to receive the argon-oxygen-containing stream from the lower pressure column and produce an argon-rich vapor stream and an argon-oxygen containing liquid by cryogenic rectification within the argon column, wherein a portion of the argon-oxygen containing liquid is directed to the lower pressure column; (v) an argon condensing assembly disposed within the lower pressure column and configured to condense the argon rich vapor stream from the argon column against an oxygen-enriched mixed liquid stream to produce argon-rich liquid stream and to partially vaporize the oxygen-enriched mixed liquid stream; and (vi) a collection trough disposed in the lower pressure column at a location above the argon condensing assembly and configured to receive a down-flowing liquid in the lower pressure column and the oxygen-enriched liquid from the higher pressure column and produce the oxygen-enriched mixed liquid stream, the collection trough further coupled to the argon condensing assembly and configured to supply the oxygen-enriched mixed liquid stream to one or more boiling passages of the argon condensing assembly, wherein a portion of the argon-rich liquid stream is extracted from the lower pressure column.

In some embodiments, the argon condensing assembly is a stripping reflux condenser configured to separate the oxygen-enriched mixed liquid stream into an ascending vapor stream that comprises the vaporized portion of the oxygen-enrich mixed liquid stream and a descending liquid stream that comprises the non-vaporized portion of the oxygen-enrich mixed liquid stream. The condenser assembly may include two or more down-flowing once-through argon condenser cores or may be constructed as a single down-flowing, once through condenser core. The separation of the oxygen-enriched mixed liquid stream in the stripping reflux argon condenser is equivalent to between about 2 stages and 8 stages of separation in the lower pressure column. In addition, the flow of the descending liquid stream within the argon condensing assembly is sufficient to keep surfaces of the argon condensing assembly wetted and prevent the argon condensing assembly from boiling to dryness. Depending on the amount of liquid needed The method of claim 1 further comprising the step of diverting a portion of the oxygen-enriched mixed liquid stream or a portion of the down-flowing liquid from the lower pressure column such the diverted portion bypasses the argon condensing assembly.

BRIEF DESCRIPTION OF THE DRAWINGS

The above and other aspects, features, and advantages of the present invention will be more apparent from the following, more detailed description thereof, presented in conjunction with the following drawings, in which.

Some of the common elements in the various Figs utilize the same numbers where the explanation of such elements would not change from Fig. to Fig.

DETAILED DESCRIPTION

Figure 1:
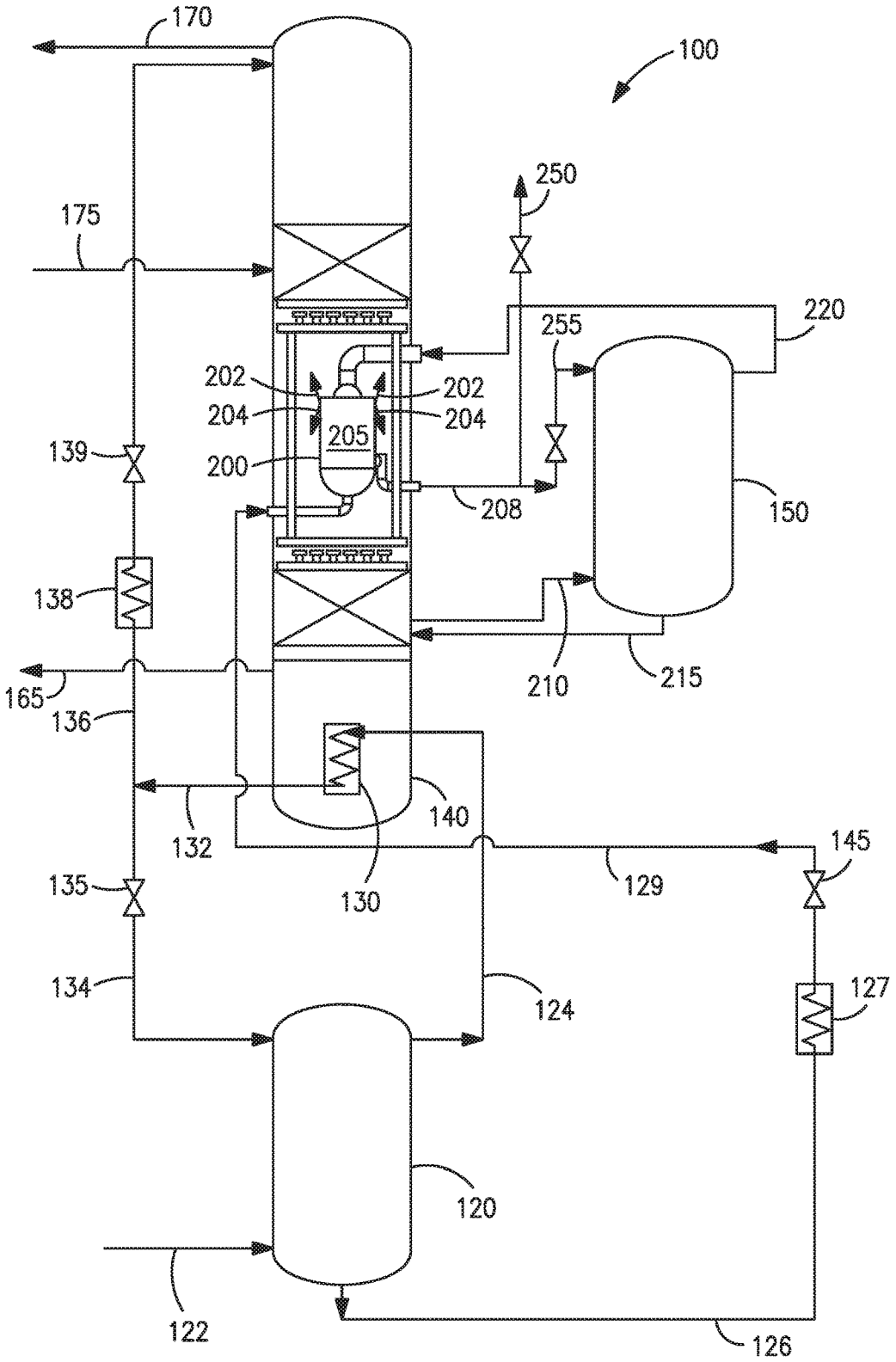
FIG. 1 shows a general schematic illustration of a portion of a cryogenic air separation unit configured to produce nitrogen, oxygen and argon products using a three column system in accordance with an embodiment of the present invention.
Figure 4:
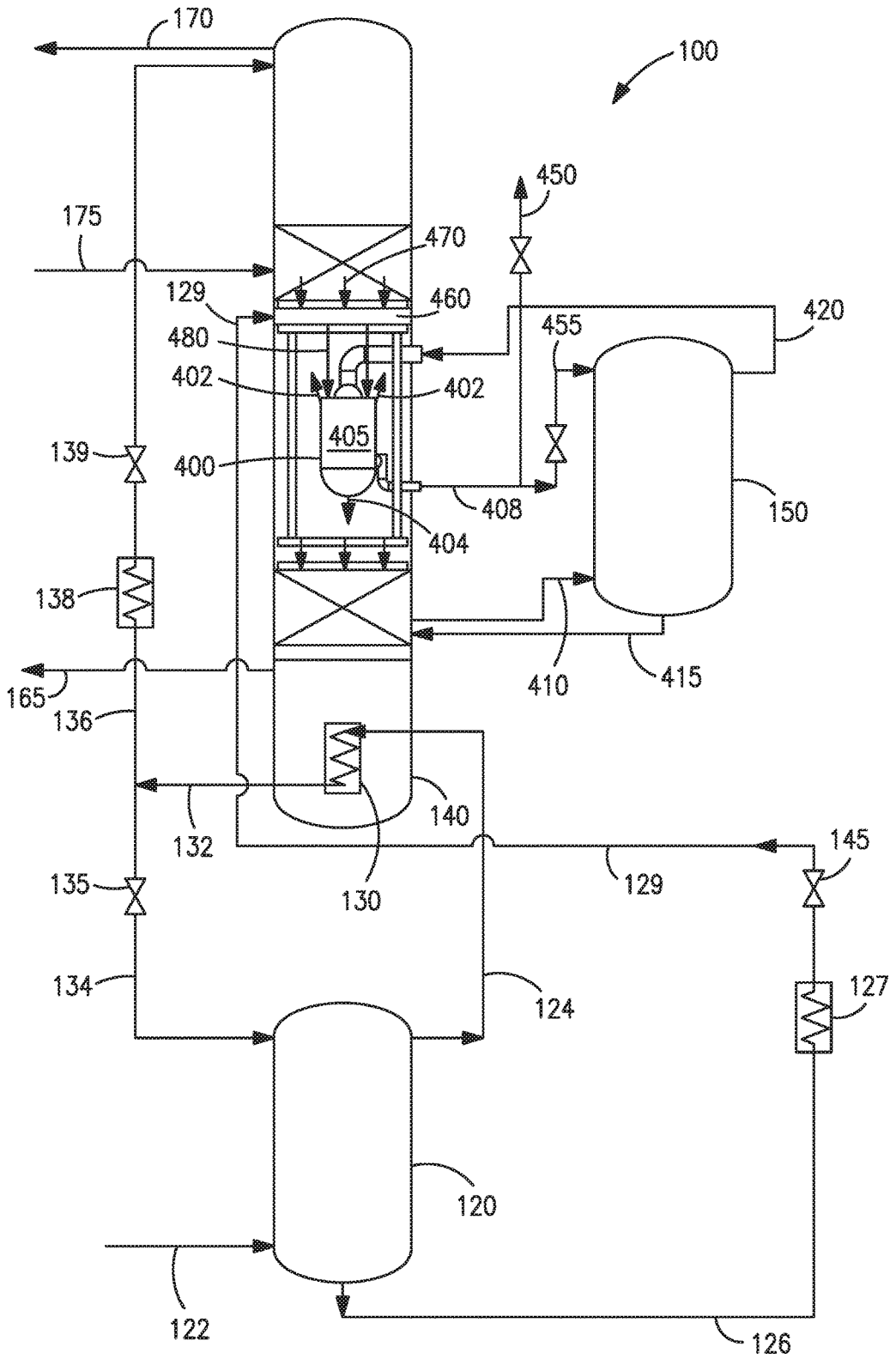
FIG. 4 shows a schematic illustration of a portion of a cryogenic air separation unit configured to produce nitrogen, oxygen and argon products using a three column system in accordance with an alternate embodiment of the present invention.

To aid in the understanding of the present argon recovery system and process, it is useful to understand the general process for the cryogenic separation of air to produce nitrogen, oxygen and argon products using a three column system. With reference to FIG. 1 and FIG. 4, a clean, pressurized air stream is introduced into the air separation process. This clean, pressurized air stream is generally divided into two or more column feed streams, the first of which is cooled in a main heat exchanger (not shown) and fed directly to the high pressure distillation column 120 via line 122, where it is rectified into a nitrogen-rich overhead stream and a crude liquid oxygen bottoms or kettle liquid as it is commonly known. The second column feed stream or second portion of the feed air is also cooled in the main heat exchanger, expanded, and subsequently fed via line 175 to the low pressure distillation column 140 at an upper-intermediate location.

The nitrogen-rich overhead stream produced in the higher pressure distillation column 120 is removed from high pressure column 120 via line 124 and condensed in reboiler/condenser 130, which is typically located in the bottoms liquid sump of low pressure distillation column 140. Upon condensing, the nitrogen-rich liquid stream is removed from reboiler/condenser 130, via line 132, and split into two or more portions. A first portion is returned to the top of high pressure distillation column 120, via line 134 and valve 135 to provide reflux whereas a second portion in line 136, is sub-cooled in heat exchanger 138, reduced in pressure by valve 139 and fed to a location near the top of low pressure column 140 as reflux.

To complete the air separation cycle, a low pressure nitrogen-rich overhead is removed via line 170 from the top of low pressure distillation column 140, warmed to recover refrigeration in the main heat exchangers (not shown), and removed from the process as low pressure nitrogen product. An oxygen-enriched vapor stream is removed, via line 165, from the vapor space in low pressure distillation column 140 above reboiler/condenser 130, warmed in a heat exchanger (not shown) to recover refrigeration and removed from the process as gaseous oxygen product. Although not shown, an upper nitrogen-rich vapor stream may also be removed from low pressure distillation column 140, warmed to recover refrigeration in the main heat exchangers (not shown), and then vented from the process as waste.

Argon Recovery with Once Through Argon Condenser

An embodiment of a system and method for argon recovery using a once-through argon condenser disposed within the lower pressure column of an air separation unit and its advantages will now be described in more detail with reference to FIGS. 1-3. The illustrated embodiment provides an improved method and arrangement for argon recovery from an air separation system 100 configured with a high pressure distillation column 120, a low pressure distillation column 140 and a argon column 150. As seen therein, the improved method and arrangement for argon recovery comprises condensing the argon-rich, overhead vapor 220 from the top of the argon column 150 in an argon condensing assembly 200 disposed at an intermediate location within the low pressure distillation column 140. The argon-rich vapor in line 220 is condensed in argon condensing assembly 200 via indirect heat exchange with a flow of oxygen-enriched kettle liquid fed via line 129 from high pressure distillation column 120.

Preferably, the crude liquid oxygen bottoms or kettle liquid from high pressure distillation column 120 is removed via line 126, sub-cooled in heat exchanger 127, reduced in pressure via valve 145, and directed to the argon condensing assembly 200 where it is heat exchanged with argon vapor overhead from the argon distillation column 150 to partially vaporize the oxygen-enriched kettle liquid. The vapor portion of the partially vaporized stream is released (shown as arrows 202) at an intermediate location of low pressure distillation column 140 for rectification. Similarly, the liquid portion of the partially vaporized stream is also released at (shown as arrows 204) an intermediate location of low pressure distillation column 140 for rectification.

An argon-oxygen-containing side stream is removed from a lower-intermediate location of low pressure distillation column 140 and fed via line 210, to argon distillation column 150 for rectification into a argon-rich overhead stream and a bottoms liquid which is recycled via line 215, back to the low pressure distillation column 140. The argon-rich overhead stream is removed from argon distillation column 150 via line 220 and is then fed to the argon condensing assembly 200 where the argon-rich stream is condensed against the sub-cooled, crude liquid oxygen bottoms from the high pressure distillation column 120. A portion of the condensed argon is returned to argon distillation column 150 via line 255 to provide reflux while a portion of the liquid argon may be removed as product via line 250. Alternatively, argon product may be removed as vapor from line 220 (not shown).

The argon condensing assembly 200 preferably comprises one or more once-through argon condenser cores 205 and disposed at an intermediate location within the low pressure distillation column 140 where the argon-rich overhead vapor from the argon distillation column 150 flows in a counter flow arrangement against sub-cooled and lower pressure kettle liquid or bottoms liquid from the high pressure distillation column 120. The boil-up from the argon condensing assembly 200 would be a two phase (vapor/liquid) stream 202, 204 that is released into lower pressure column 140 for further rectification. The condensed, argon-rich liquid is removed from a location proximate the bottom of the argon condensing assembly 200 via line 208 and split into two portions. The first portion is fed to the top of the argon column 150 via line 255 to provide reflux for the argon column 150. The second portion is removed from the process via line 250 as liquid argon product.

Figure 3:
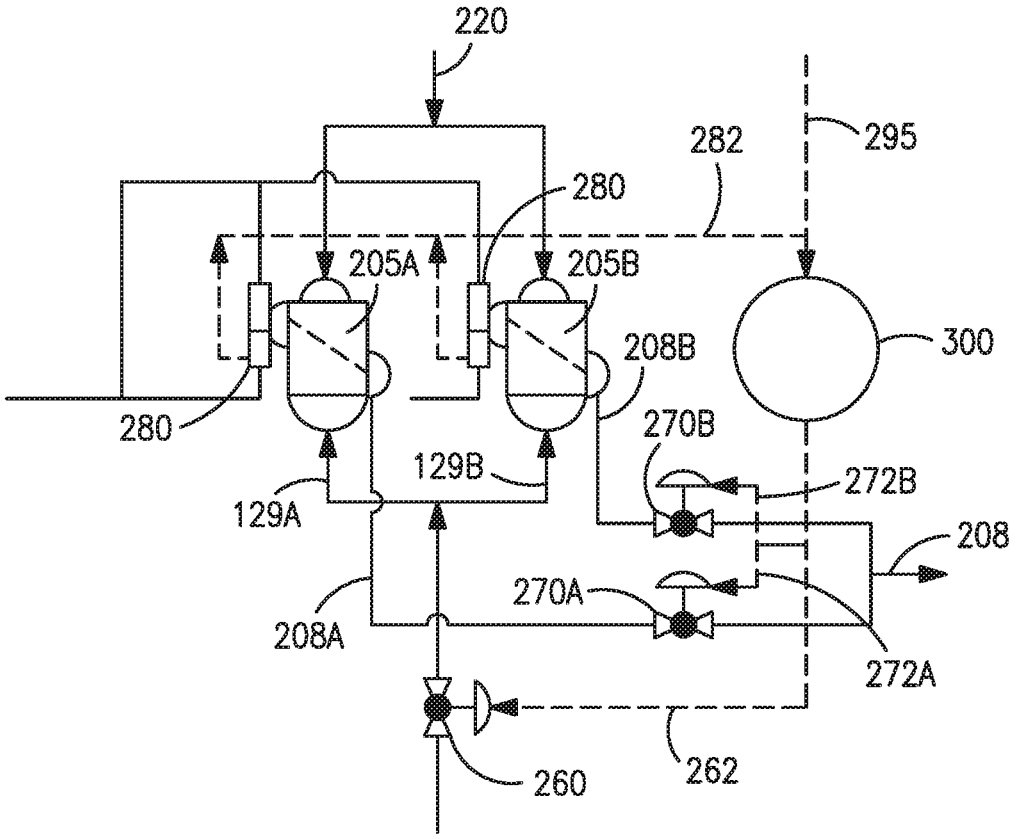
FIG. 3 shows a schematic illustration of a control scheme useful in conjunction with one of the present embodiments of the argon condensing assembly used in the argon recovery system and methods disclosed herein.

Operational control of the present argon recovery method and system is achieved, in part, with a control system comprising two distinct control features or elements, broadly depicted in FIG. 3. The first control feature or element provides an even flow split of the kettle liquid 129A, 129B between multiple argon condenser cores 205A, 205B to ensure sufficient liquid is present to keep the surfaces of all argon condenser cores wetted. The second control feature or element provides control of the argon flow 208A, 208B removed from each argon condenser core 205A, 205B to maintain the liquid/vapor balance in each argon condenser core 205A, 205B within appropriate limits. In addition, this second control feature or element also operates to adjust the split of liquid argon to be used as reflux for the argon column and to be removed as argon product in order to optimize argon recovery.

The present argon recovery control system preferably comprises a controller 300 operatively coupled to one or more control valves 260, 270A, 270B associated with the supply of the sub-cooled kettle liquid 129A, 129B to the argon condenser cores 205A, 205B and with the removal of condensed argon 208A, 208B from the argon condenser cores 205A, 205B. In particular, one or more control valves 260 are disposed upstream of the argon condenser cores 205A, 205B and in association with the kettle liquid supply. In addition, argon flow regulating valves 270A, 270B are preferably disposed downstream of the argon condenser core outlets.

Such argon flow regulating valves 270A, 270B operatively control or adjust the argon flow removed from each argon condenser cores 205A, 205B and maintain the liquid/vapor balance in each argon condenser core within appropriate limits. The argon flow regulating valves 270A, 270B may also be configured to adjust the split of liquid argon to be used as reflux for the argon column and to be removed as argon product. Both the control valves 260 and the argon flow regulating valves 270A, 270B are responsive to various inputs and feedback including the liquid/vapor balance in the kettle liquid exiting each argon condenser core 205A, 205B as measured by one or more liquid to vapor mass flow ratio indicators 280 as well as the differences in the liquid/vapor balance exiting each argon condenser core 205A, 205B ascertained by a differential level sensor.

When using multiple argon condensing cores as depicted in FIG. 3, it is also important to control the condensing rates of the condenser cores such that the performance and/or output of each condenser core is similar or comparable. Control of the argon recovery system and process is achieved, in part, by controlling the flow of the kettle liquid from the high pressure column to the argon condenser cores via valve 260 controlled via signal 262 with the aim to ensure a sufficient and generally even split of the kettle flow to each argon condenser core. To achieve such control, the quality characteristics of the boiling liquid or kettle liquid exiting each argon condenser core 205A, 205B are measured and compared. If one argon condenser core has an exit stream of higher quality than the other condenser core or cores, the condensing rate of that one argon condenser core is reduced to generally match the exit quality of the other condenser cores. Specifically, the amount of liquid and gas in the kettle exit flow as measured by indicators 280 and signals 282 is used to determine the differential liquid to vapor mass flow ratio (L/V) between different argon condenser cores. This difference in L/V is provided as an input and/or feedback to the present control system along with other system flow measurement signals 295.

Using the difference in L/V as a control parameter, the kettle flow to an argon condenser core is adjusted until the measured exit quality of the condenser core is within an allowable range of the other condenser cores. Since the control valves 260 also regulate the liquid level in the kettle of the higher pressure column, the control algorithm must control with feedback from a lower column level indicator and the L/V measurements via input signal 295. In conjunction with the flow control, the argon flow regulating valve can also used to regulate the condensing load on the condenser cores to reduce or increase the condensing load as needed.

Increasing the argon liquid level in the argon condenser core generally decreases the heat transfer performance of the argon condenser core which reduces the condensing rate.

The difference in L/V measurements is also used to adjust the valve position of the argon regulating valves 270A, 270B via signal 272A and 272B until the exit quality of each condenser core is within an allowable range of the other condenser cores. However the present control system must also control the rate of argon flow from the lower pressure column to the argon column. Therefore the preferred control algorithms must adjust the argon regulating valve position with feedback from both an argon flow indicator as well as the L/V measurements.

To help achieve an even flow and mix of kettle liquid and vapor to each argon condenser core a generally symmetrical pipe network to and from each condenser core as well as a common distributor is used. For two condensers a vertically oriented symmetric Y-shaped adapter or fitting is used to split the two phase flow to each argon condenser core. Similar fittings can be employed where the argon recovery system uses more than two argon condenser cores. Other portions of the argon recovery system piping network such as pipe lengths, pipe diameter, and elevation or directional changes are generally kept equivalent or similar for each argon condenser core.

A common distributor is coupled to the inlet header of each argon condenser core. The distributor is used to mix and evenly distribute the two phase kettle flow which enters the argon condenser cores. Using a distributor ensures sufficient kettle liquid is distributed to each condenser core and prevents dryout in portions of the condenser cores. The preferred distributor is a perforated plate or baffle due to its low pressure drop and simplicity.

Argon Recovery with Stripping Reflux Argon Condenser

Figure 2:
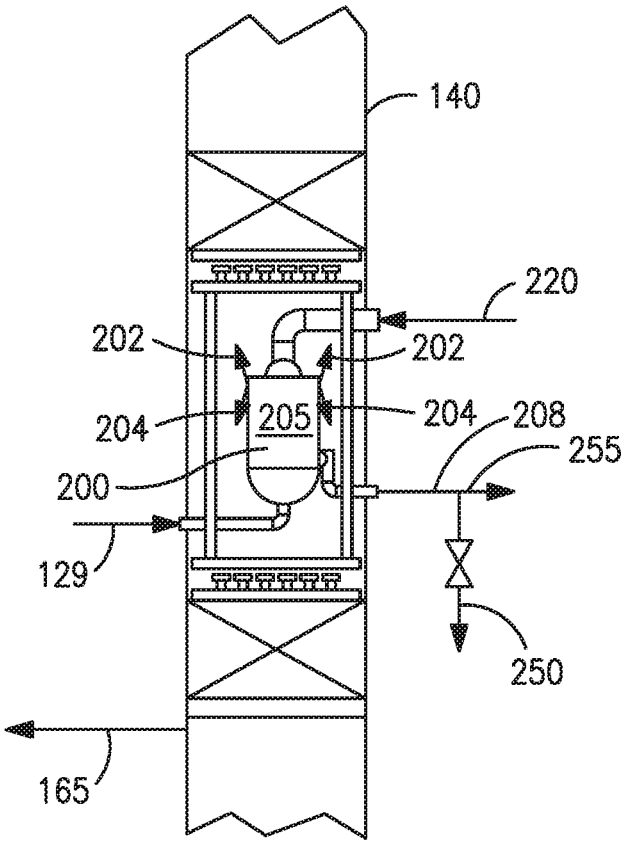
FIG. 2 shows a schematic illustration of an embodiment of the argon condensing assembly of FIG. 1.

An alternative embodiment to that described with reference to FIGS. 1-3 is shown in FIG. 4. As seen therein, the improved method and arrangement for argon recovery comprises condensing the argon-rich, overhead vapor 420 from the top of the argon column 150 in an argon condensing assembly 400 disposed at an intermediate location within low pressure distillation column 140. The argon-rich vapor in line 420 is condensed in the argon condensing assembly 400 via indirect heat exchange with a flow of oxygen-enriched mixed liquid stream 480. The oxygen-enriched mixed liquid stream 480 comprises the oxygen-enriched kettle liquid 129 from higher pressure column 120 of the cryogenic air separation unit and a down-flowing liquid 470 in the upper distillation section of the lower pressure column 140. The oxygen-enriched kettle liquid 129 and the down-flowing liquid 470 are preferably mixed in a collection trough 460. As in the earlier described embodiments, the crude liquid oxygen bottoms or kettle liquid from high pressure distillation column 120 is removed via line 126, sub-cooled in heat exchanger 127, reduced in pressure via valve 145, and directed to lower pressure column 140.

In the preferred embodiment, a liquid stream is discharged from the trough 460 and fed into the boiling passages of an argon condensing assembly 400. In this arrangement, the argon condensing assembly 400 is preferably a stripping reflux type condenser arranged or oriented in a down-flow configuration. Also, the stripping reflux argon condenser further includes boiling or stripping passages allowing the boiling vapor to exit near the top of the argon condensing assembly 400.

Below the argon condensing assembly 400, an argon-oxygen-containing side stream is removed from the low pressure distillation column 140 and fed via line 410 and directed to the argon distillation column 150 for rectification into a argon-rich overhead stream and a bottoms liquid which is recycled via line 415 back to the low pressure distillation column 140. The argon-rich overhead stream is removed from argon distillation column 150 via line 420 and is then fed to the argon condensing assembly 400 where the argon-rich stream is condensed against the oxygen-enriched mixed liquid stream 480. A first portion of the condensed argon is returned to argon distillation column 150 via line 455 to provide reflux while a second portion of the liquid argon may be removed as product via line 450.

The argon condensing assembly 400 preferably comprises one or more once-through argon condenser cores 405 and disposed at an intermediate location within the low pressure distillation column 140 where the argon-rich overhead vapor from the argon distillation column 150 is condensed. The resulting vapor portion of the oxygen-enriched mixed liquid stream 480 is partially vaporized within the argon condensing assembly 400 and the vapor portion is released (shown as arrows 402) at an intermediate location of low pressure distillation column 140 for further rectification. Similarly, the liquid portion of the partially vaporized stream is also released at (shown as arrows 404) an intermediate location of low pressure distillation column 140 for further rectification.

As a result, the stripping reflux type argon condenser of the type shown in FIG. 4 preferably provides the equivalent of two (2) to eight (8) stages of separation of the down-flowing liquid, and thus improves the argon recovery by about 1.0 percent to about 3.0 percent compared to conventional argon recovery. Moreover, the percent increase in argon recovery is further improved during high liquid nitrogen production modes when argon recovery is relatively low. If enhanced argon recovery is not required, the benefits of the present system and method may be translated to net power savings provided there is sufficient gas nitrogen demand by drawing more shelf nitrogen to the point where argon recovery is unchanged.

Another advantage of this alternative embodiment compared to the previously disclosed embodiments is that the liquid to vapor ratio (L/V) exiting the once through stripping reflux argon condenser is much greater since the volume of liquid passing through the boiling side of the condenser (i.e. down-flowing liquid from the lower pressure column together with kettle liquid from the higher pressure column) is greater and most of the resulting boiling vapor exits the top of the condenser. This increased liquid to vapor ratio exiting the argon condenser greatly increases the safety aspects of the argon condenser in that it prevents boiling to dryness and keeps the condensing surfaces sufficiently wetted.

In some embodiments of the arrangement depicted in FIG. 4, it may be beneficial to have a portion of the down-coming liquid from the lower pressure column bypass the trough and also thereby bypass the argon condenser. Similarly, it is also possible to divert a portion of the liquid stream discharged from the collection trough so as to bypass the stripping reflux argon condenser. Such bypassing arrangements may be employed to optimize the size and/or girth of the internally disposed argon condenser. Also, the amount of liquid to be diverted or to bypass the argon condenser will be limited so as to ensure sufficient wetting of the argon condenser surfaces is maintained.

One of the key differences or improvements of the present systems and methods compared to the prior art argon recovery systems and methods is that all or substantially all of the flow of kettle liquid from the high pressure column is directed to the argon condensing assembly or the collection trough coupled to the argon condensing assembly. Providing a large flow of kettle liquid to the argon condensing assembly (or collection trough) simplifies the packaging and ensures that localized or periodic boiling to dryness within the condenser cores will be prevented which improves the safety aspect of the argon recovery in that avoids hydrocarbon deposition on surfaces within the argon condensing assembly.

A key cost advantage of the present systems and methods described herein include the fact that no separate vessel is required to house the argon condensing assembly. Another key advantage is the reduced or simplified piping, valve and column packages required by the present system resulting in potentially reduced cold box height. Lastly, the control system and scheme also provides certain advantages to ensure a safe and balanced operation of the argon recovery system and process.

The preferred stripping reflux argon condenser is a falling film type microchannel tube heat exchanger that achieves simultaneous heat and mass transfer on the boiling side of crude argon condenser. The preferred condenser also consists of a plurality of cores or modules, each having hundreds of aluminum microchannel tubes used as the heat and mass transfer elements and connected by common headers. The modules are preferably arranged in a stacked orientation to simulate a structured packing arrangement. The plurality of microchannel tubes function to condense the argon vapor and provide an equivalent of at least 3 or 4 stages of mass transfer on the boiling side.

Contemplated microchannel type heat exchanger configurations might include a flat tube arrangement with multiple microchannel ports per flat tube or a plurality of round single port microchannel tubes. Typically, a single microchannel tube diameter is about 0.5 mm to 2 mm whereas the flat tube width is about 5 mm to 25 mm. In either arrangement, the microchannel tubes are preferably arranged in a generally parallel orientation and connected via common inlet and outlet headers for argon vapor flow inside the microchannel tubes. In the contemplated configurations, the argon vapor flows inside the microchannel tubes and the falling liquid (e.g. oxygen-enriched mixed liquid stream) forms a thin liquid film on the outer surface of microchannel tubes thereby defining the contact area between the falling liquid and boiloff vapor to achieve the stripping effect of the condenser. In addition, a porous surface coating could be applied on the outside surfaces of microchannel tubes to enhance the heat transfer performance on the boiling side of the stripping reflux argon condenser.

While the present invention has been described with reference to preferred embodiments, as will be understood by those skilled in the art, numerous additions and omissions can be made without departing from the spirit and scope of the present invention as set forth in the appended claims.

What is claimed is:

1. A method for producing argon in a cryogenic air separation unit comprising the steps of:

(a) rectifying a feed air stream in a higher pressure column and a lower pressure column of the cryogenic air separation unit to produce an oxygen product stream and a nitrogen product stream, wherein the higher pressure column and the lower pressure column each have a plurality of separation stages configured to separate nitrogen and oxygen from a descending liquid stream and an ascending vapor stream in the respective columns;

(b) rectifying an argon-oxygen-containing stream taken from the lower pressure column in an argon column configured to produce an argon-rich vapor stream and an argon-oxygen containing liquid;

(c) directing the argon rich vapor stream from the argon column to a down-flowing, once-through stripping reflux condenser configured to achieve simultaneous heat and mass transfer in one or more boiling passages of the stripping reflux condenser, the stripping reflux condenser disposed at an intermediate location within a lower pressure column of the cryogenic air separation unit;

(d) directing the argon-oxygen containing liquid from the argon column to an intermediate location of the lower pressure column below the down-flowing, once-through stripping reflux condenser;

(e) mixing a flow of an oxygen-enriched liquid from the higher pressure column of the cryogenic air separation unit with the descending liquid in the lower pressure column in a collection trough disposed in the lower pressure column at a location immediately above the down-flowing, once-through stripping reflux condenser to form an oxygen-enriched mixed liquid stream;

(f) feeding the oxygen-enriched mixed liquid stream to the down-flowing, once-through stripping reflux condenser;

(g) condensing the argon rich vapor stream against the oxygen-enriched mixed liquid stream in the argon condensing assembly to produce a argon-rich liquid stream while vaporizing a portion of the oxygen-enriched mixed liquid stream in the down-flowing, once-through stripping reflux condenser and stripping nitrogen from the oxygen-enriched mixed liquid stream, the stripped nitrogen included in the vaporized portion, wherein the stripping of nitrogen from the oxygen-enriched mixed liquid stream in the down-flowing, once-through stripping reflux condenser is equivalent to the stripping of nitrogen that occurs in 2 stages to 8 stages of separation in the lower pressure column;

(h) releasing the vaporized portion of the oxygen-enriched mixed liquid stream including the separated nitrogen from the down-flowing, once-through stripping reflux condenser into the lower pressure column at a location proximate the top of the down-flowing, once-through stripping reflux condenser;

(i) releasing the non-vaporized portion of the oxygen-enriched mixed liquid stream from the down-flowing, once-through stripping reflux condenser into the lower pressure column at a location proximate the bottom of the down-flowing, once-through stripping reflux condenser; and (j) removing at least a portion of the argon-rich liquid stream from the down-flowing, once-through stripping reflux condenser in the lower pressure column;

wherein the flow of the oxygen-enriched mixed liquid stream within the down-flowing, once-through stripping reflux condenser is sufficient to keep surfaces of the down-flowing, once-through stripping reflux condenser wetted and prevent the down-flowing, once-through stripping reflux condenser from boiling to dryness; and wherein argon recovery from the cryogenic air separation unit is increased by virtue of the separation of nitrogen from the oxygen-enriched mixed liquid stream in the down-flowing, once-through stripping reflux condenser.

2. The method of claim 1 wherein the down-flowing, once-through stripping reflux condenser is a falling film type microchannel tube condenser.

3. The method of claim 1 wherein the down-flowing, once-through stripping reflux condenser comprises two or more down-flowing once-through argon condenser cores.

4. The method of claim 1 further comprising the step of returning a portion of the argon-rich liquid stream to the argon column as reflux.

5. The method of claim 1 further comprising the step of taking a portion of the argon-rich liquid stream as an argon product.

6. A system for producing an argon product by cryogenic rectification of a feed air stream comprising:

a source of compressed and purified feed air;

a higher pressure column configured to produce an oxygen-enriched liquid and a nitrogen-rich overhead stream by cryogenic rectification of a portion of the compressed and purified feed air within the higher pressure column;

a lower pressure column configured to receive the nitrogen rich overhead stream from the higher pressure column and produce an oxygen product stream and a nitrogen-rich stream by cryogenic rectification within the lower pressure column as well as an argon-oxygen-containing side stream;

an argon column operatively coupled to the lower pressure column and configured to receive the argon-oxygen-containing stream from the lower pressure column and produce an argon-rich vapor stream and an argon-oxygen containing liquid by cryogenic rectification within the argon column, wherein a portion of the argon-oxygen containing liquid is directed to the lower pressure column;

a down-flowing, once-through stripping reflux condenser configured to achieve simultaneous heat and mass transfer in one or more boiling passages of the stripping reflux condenser, the down-flowing, once-through stripping reflux condenser disposed at an intermediate location within the lower pressure column and configured to condense the argon rich vapor stream from the argon column against an oxygen-enriched mixed liquid stream to produce argon-rich liquid stream while vaporizing a portion of the oxygen-enriched mixed liquid stream in the down-flowing, once-through stripping reflux condenser and stripping nitrogen from the oxygen-enriched mixed liquid stream, the stripped nitrogen included in the vaporized portion, wherein the stripping of nitrogen from the oxygen-enriched mixed liquid stream in the down-flowing, once-through stripping reflux condenser is equivalent to the stripping of nitrogen that occurs in 2 stages to 8 stages of separation in the lower pressure column; and a collection trough disposed in the lower pressure column at a location immediately above the down-flowing, once-through stripping reflux condenser and configured to receive a down-flowing liquid in the lower pressure column and the oxygen-enriched liquid from the higher pressure column and produce the oxygen-enriched mixed liquid stream, the collection trough further coupled to the down-flowing, once-through stripping reflux condenser and configured to supply the oxygen-enriched mixed liquid stream to the one or more boiling passages of the down-flowing, once-through stripping reflux condenser;

wherein a portion of the argon-rich liquid stream is extracted from the lower pressure column;

wherein the flow of the oxygen-enriched mixed liquid stream within the down-flowing, once-through stripping reflux condenser is sufficient to keep surfaces of the down-flowing, once-through stripping reflux condenser wetted and prevent the down-flowing, once-through stripping reflux condenser from boiling to dryness; and wherein argon recovery from the cryogenic air separation unit is increased by virtue of the separation of nitrogen from the oxygen-enriched mixed liquid stream in the down-flowing, once-through stripping reflux condenser.

7. The system of claim 6 wherein a portion of the argon-rich liquid stream is recycled back to the argon column as reflux.

8. The system of claim 6 wherein a portion of the argon-rich liquid stream is taken as the argon product.

9. The system of claim 6 wherein the down-flowing, once-through stripping reflux condenser comprises two or more down-flowing once-through argon condenser cores.

10. The system of claim 6 wherein the down-flowing, once-through stripping reflux condenser is a falling film type microchannel tube condenser.

* * * * *